United States Patent [19]

Seragnoli

[11] 4,190,163

[45] Feb. 26, 1980

[54] DEVICE FOR CHECKING THAT THE BANDS JOINING FILTERS TO CIGARETTES HAVE BEEN SEALED DOWN

[75] Inventor: Enzo Seragnoli, Bologna, Italy

[73] Assignee: G. D. Societa per Azioni, Bologna, Italy

[21] Appl. No.: 919,691

[22] Filed: Jun. 27, 1978

[30] Foreign Application Priority Data

Sep. 26, 1977 [IT] Italy ..... 3558 A/77

[51] Int. Cl.[2] ..... B07C 5/00

[52] U.S. Cl. ..... 209/535; 209/940

[58] Field of Search ..... 209/537, 535, 591, 644, 209/932, 940

[56] References Cited

U.S. PATENT DOCUMENTS

| | | | |
|---|---|---|---|
| Re. 28,931 | 8/1976 | Lehmann | 209/537 |
| 2,560,737 | 7/1951 | Palmer, Jr. | 209/932 X |
| 3,456,787 | 7/1969 | Pinkham et al. | 209/535 |
| 3,483,970 | 12/1969 | McArthur | 209/537 |
| 3,485,357 | 12/1969 | Payne | 209/537 |
| 3,720,311 | 3/1973 | Harrison, Jr. | 209/537 |

FOREIGN PATENT DOCUMENTS

| | | | |
|---|---|---|---|
| 1110268 | 4/1968 | United Kingdom | 209/535 |

*Primary Examiner*—Joseph J. Rolla
*Assistant Examiner*—Edward M. Wacyra
*Attorney, Agent, or Firm*—Browdy and Neimark

[57] ABSTRACT

A device for checking the complete sealing of filters to cigarettes by subjecting cigarettes being transported by a rotary transfer drum to an axial air flow to displace acceptable cigarettes. The unacceptable ciagarettes are unable to be displaced and are impinged upon by an outwardly directed air flow to expel these cigarettes from the transfer drum.

8 Claims, 4 Drawing Figures

DEVICE FOR CHECKING THAT THE BANDS JOINING FILTERS TO CIGARETTES HAVE BEEN SEALED DOWN

BACKGROUND OF THE INVENTION

This invention relates to a device for checking that the bands joining filters to cigarettes have been sealed down, and more precisely to a device of a mechanical type which is able to detect faults in the sealing of the said bands and to subsequently reject the cigarettes found to be defective.

In accordance with the known practice, the fitting of the filters to the cigarettes is attended to by what are known as filter application machines, and this is done in the stages mentioned briefly below.

The cigarettes are placed two by two in axial alignment, and a filter cutting of a length double that for one single cigarette is interposed between them, along the same alignment and in contact with the extremities thereof. The ensemble constituted by the two cigarettes and the said cutting is joined by means of a band of paper material which is wound so as to cover the filter cutting and each of the said extremities over a distance of approximately 3 mm.

The terminal flaps of the said band, one of which previously gummed, are superposed one over the other.

A cutting device then divides each ensemble into two cigarettes complete with filter.

The said stages are concluded by devices which, rotating one of the cigarettes in each pair by 180°, create a succession of cigarettes aligned transversely with respect to their longitudinal axes.

During the said operation, however, cases are not infrequent of imperfect gumming or of either the mechanical stress of the cutting means or of the subsequent transfer means causing the terminal sealing flap on the joining band to open up and to protrude like a flag on the outside of the normal profile of the cigarette, as shown in FIG. 1.

It is obvious that this abnormal arrangement of the terminal flap of the band can cause various problems that are certainly not negligible during the subsequent operations of transferring and infeeding the cigarettes to the packeting machine.

In particular, cigarettes with the said fault that have not been immediately detected and eliminated, cause an interruption in the infeed flow inside the hopper in which the batches of cigarettes destined to be packeted are formed.

Not only does this act negatively on the production efficiency of the packeting machine but, for normal operating conditions to be resumed, it necessitates manual action being taken to remove the individual defective cigarettes from the said hopper.

The suitability can be seen from the foregoing of having a check on the condition of the band on each individual cigarette, and of this being carried out immediately the cigarettes exit from the filter application machine or wherever it is possible to effect the check on a succession of individual cigarettes.

Insofar as the Applicants herein are aware, devices are not known that have been expressly studied to trace and reject filter cigarettes having the described fault, that is to say, cigarettes in which a terminal flap on the band joining the cigarette to the filter, because of its being badly gummed, projects "flag" fashion on the outside of the normal profile of the cigarette, but only devices for checking the joining of the filter to the cigarette.

A first device with which to verify the mechanical strength of the said joint is described in British Pat. No. 1,086,935, and this envisages the provision of means for exerting axial stress on filter cigarettes whereby the filter tends to be separated from that part of the cigarette in which the tobacco is contained.

In one form of embodiment for the said device, the cigarettes are carried with a movement direction perpendicular to their axes, on a conveyor belt which supports them. The described check takes place in an area where a second belt is positioned overhead of the first conveyor belt, this being wound continuously around horizontal rollers, the said second belt extending parallel to the first belt at a distance away from this that is approximately a little less than the diameter of a cigarette.

At the side of the said conveyor belts there are two identical superposed belts that extend in a direction slightly horizontally oblique with respect to the direction in which the cigarettes move and between these the filters of the cigarettes being carried pass.

Thus the cigarettes move in a direction perpendicular to their axes, with the filters held firmly between the said latter pair of belts and the parts containing the tobacco gripped lightly between the first two belts. Because of the movement component of the pair of belts through which the filters pass being directed axially with respect to the cigarettes, axial stress is applied to these which tends to separate them from the filters, and which ought to do this when the jointing is poor.

Whilst, however, the said device may be efficient as regards the detection of cigarettes where the cigarette-filter joint is very obviously poor, it often fails to report the fault mentioned above where the terminal flap of the band joining the cigarette to the filter has been poorly gummed and protrudes in the form of a flag, for the detection of which the apparatus of the Applicants herein has been studied.

On cigarettes, in fact, where only a small flap on the jointing band has become unstuck, the tensile strength of the latter is often only very slightly different from that ascertained on normal cigarettes.

Furthermore, it should be noted that the device described subjects the cigarettes to undesirable stress which can cause them damage.

A second device, described in British Pat. No. 1,468,226, envisages the use of pneumatic means with which to trace openings in the rolling of the cigarettes.

With the said device, the cigarettes are carried in a movement direction perpendicular to their axes by slotted rotating cylinders onto which they are held by suitable suction means.

The check is effected by connecting at least one end of the cigarettes to a source of positive or negative air pressure, and by measuring the pressure of air applied. With cigarettes on which there are openings in the rolling or in the filter jointing area, leakages or infiltrations of air will occur, and the pressure values measured will thus vary with respect to those applicable to normal cigarettes.

The said device, which can also be used to trace cigarettes on which the filter jointing band has not been properly gummed, although it was not studied expressly for this particular purpose, presents difficulties, however, since it is considerably complex and necessitates the provision of devices with which to effect the check in the way outlined above. Then because of the said devices being positioned opposite one another, axially to the cigarettes, the slightest pressure applied to the ends of the latter can, especially at the high operating speeds of the fast moving check devices, cause wrinkles or folds in the cigarettes and thus consequential damage to them.

SUMMARY OF THE INVENTION

The object of the present invention is, therefore, to make available a device that is able to specifically effect the aforementioned checking operation in cases when the terminal sealing flap of the cigarette-filter jointing band has come unstuck and, furthermore, to immediately eliminate cigarettes found to be faulty.

A further object of the present invention is to make available a device of the type described above, that is of a particularly simple structure, offers a high degree of reliability and is able to handle the cigarettes delicately whilst the said checking operations are in progress.

These and other objects too have all been attained with the device according to the invention for checking that the bands joining filters to cigarettes have been sealed down, comprising means for transferring the cigarettes, one next to the other, in a movement direction crosswise to their longitudinal axes, the said means being provided with a succession of housings into which the individual cigarettes fit, the longitudinal dimensions of which are less than the length of one filter cigarette, as well as with means for retaining the cigarettes in the said housings, the said device having: first pneumatic means placed laterally with respect to the said transfer means, these generating jets of air, directed axially with respect to the cigarettes, towards and in the direction of the openings in axial alignment with the said housings into which the cigarettes fit, the width of which is approximately slightly greater than the section of one cigarette; first means for halting, inside the said housings, the movement of the cigarettes passing through the said openings with just the part around which the cigarette-filter jointing band has been placed, under the action of the said first pneumatic means, the said first halting means being placed laterally with respect to the said transfer means, on the opposite side of these to that where the said first pneumatic means are positioned; means for intercepting and ejecting the cigarettes from their respective housings in the transfer means, these being placed downstream of the said first pneumatic means in the movement direction of the said transfer means and laterally thereto on the same side as the said first pneumatic means; second pneumatic means placed downstream of the said cigarette interception and ejection means, in the movement direction of the said transfer means and laterally thereto on the same side as the said first halting means, these generating jets of air directed towards and axially to the cigarettes; second means for halting the cigarettes moving inside their respective housings in the transfer means under the action of the said second pneumatic means, these being placed laterally with respect to the said transfer means, on the side of these where the said first pneumatic means and the said interception and ejection means are located, and downstream of the latter with respect to the movement direction of the transfer means.

BRIEF DESCRIPTION OF THE DRAWING

Further characteristics and advantages will emerge more clearly from the following detailed description of a preferred form of embodiment for the device according to the invention, illustrated purely as an unlimited example in the accompanying drawings in which.

DESCRIPTION OF THE PREFERRED EMBODIMENT

Figure 3:
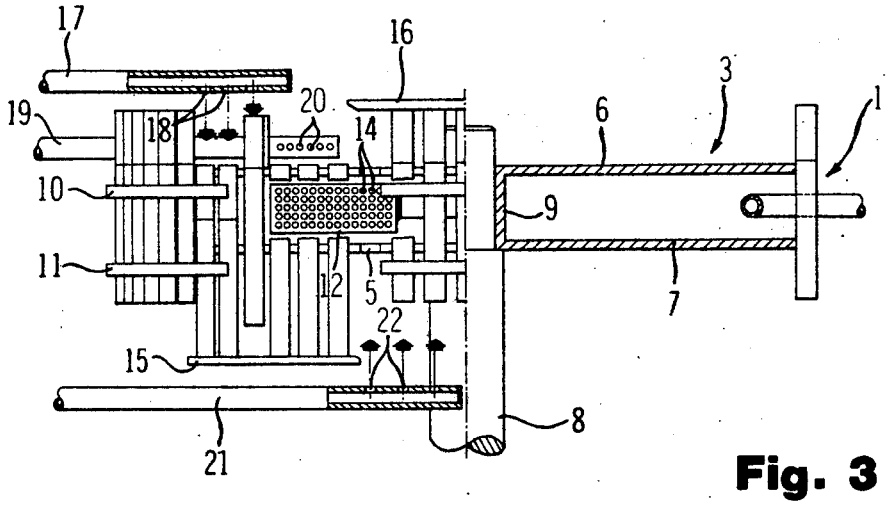
FIG. 3 shows, in a view from below, partly in sectional form along the line A—A, the same device as in FIG. 2.
Figure 2:
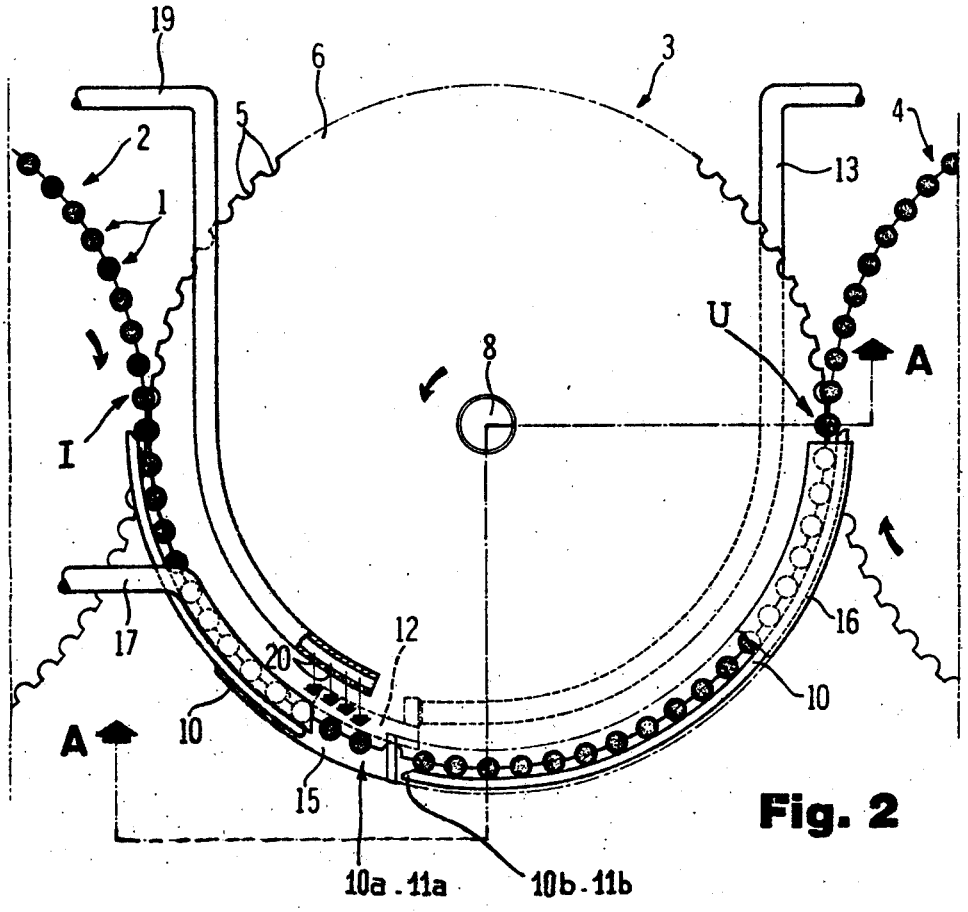
FIG. 2 shows, in a front view, the device forming the sbject of the present invention.

In FIGS. 2 and 3 means are shown for transferring the cigarettes 1 complete with filter. These are constituted by a succession of pairs of discs mounted on coplanar, horizontal, axes that are parallel with one another.

The said pairs, 2, 3 and 4, respectively, rotate with a continuous motion that is provided from one single source, not illustrated, through gearwheels connected to each of the said shafts.

The two discs in each pair are identical in diameter, are integral with each other and have all around them the slots 5.

The cigarettes 1 attach themselves to the two discs in each pair, placed parallel to the axes of rotation, inserted in the housing defined by two of the said slots 5, and retained in the said position by suction means or by guides coaxial to each pair of discs.

The pair 3, rotating anti-clockwise, receives the cigarettes from the pair 2, rotating clockwise, at a point called the inlet position I and transfer them, upon completion of a rotation through 180°, at a point called the exit position U, to the pair 4 rotating clockwise.

During the transfer of the cigarettes from the said inlet position I to the said exit position U, the check that the bands joining filters to cigarettes have been sealed down takes places, as will be seen in due course, along the lower part of the contour of the pair 3.

With special reference to the said pair 3 (see FIGS. 2 and 3), it consists of two discs, 6 and 7, respectively, mounted on a shaft 8, at a distance apart corresponding to less than the length of one cigarette complete with filter, the two discs being integral with each other through a hub 9.

Along the path followed by the cigarettes between the said inlet position I and the said exit position U, two fixed guides, 10 and 11, respectively, are provided, these being coaxial to the discs 6 and 7 and placed, in a radial direction, at a distance from the bottom of the slot 5 substantially equal to the diameter of one cigarette.

Corresponding to where there is an interruption area 10*a*–11*a* in the guides 10 and 11, between the discs 6 and 7 a hollow block 12 is interposed, bent coaxially to the shaft 8 and tangential with the housings defined by the slots 5.

The said hollow block 12 which is connected via a tube 13 to a source of suction which is not illustrated, communicates with the outside through the holes 14 drilled in the lower side thereof.

Immediately upstream of the said interruption area, outside the pair 3, on the side where the disc 7 is placed, at a distance away from the disc 6 approximately slightly less than the length of a cigarette 1 complete with filter there is a fixed or halting blade 15 and this is placed on a plane parallel with that on which the two discs lie. The said blade 15, in the form of a spherical sector coaxial with the shaft 8, is opposite the contour of the disc 7 and the guide 11.

Between the extremities **10*b*–11*b* downstream of the said interruption area in the guides 10 and 11 and the said exit position U, outside the pair 3, on the side where the disc 6 is placed, there is a second fixed or halting blade 16 parallel to the blade 15**.

The said blade 16 is also in the form of a spherical sector coaxial with the shaft 8, and it is opposite the contour of the disc 6 and the guide 10.

In between the said inlet position I and the said exit position U a number of pneumatic means are provided, and a description of these now follows.

A tube 17, outside the pair 3 on the side of the disc 6, is connected at one end to a source of compressed air which is not shown in the drawing. The other end of the tube 17 is bent coaxially to the shaft 8 with a radius virtually identical to that of the discs 6 and 7 along the same arc described by the blade 15.

From a number of holes 18 on an axis parallel to the shaft 8, interspaced over the said arc at a distance virtually the same as the pitch of the slots 5, there is an emission of jets of air directed towards the contour of the disc 6, perpendicularly thereto. A second tube 19 placed, with respect to the pair 3, on the same side as the tube 17 and connected at one end to a source of compressed air that is not illustrated, has its other end bent concentrically to the shaft 8 above the interruption area in the guides 10 and 11.

The said other end of the tube is provided in its lower part with a number of holes 20 on a vertical axis, and these emit jets of air directed perpendicularly with respect to the axes of the said housings.

A third tube 21, placed, with respect to the pair 3, on the side opposite that occupied by the blade 16, is connected at one end to a source of compressed air not shown on the drawing.

The other end of the tube 21 is bent, downstream of the interruption area **10*a*–11*a* in the guides 10 and 11, coaxially to the shaft 8 at a radius virtually identical to that of the discs 6 and 7. The said other end of the tube 21 is placed in communication with the outside through a number of horizontal axis holes 22, facing the disc 7**, from which jets of air are emitted directed along the axes of the said housings.

A description will now be given of the operation of the device forming the subject of the present invention for detecting and rejecting cigarettes having the fault shown in FIG. 1.

In the said figure, shown in its entirety there is a cigarette 1 complete with filter, whilst in greater detail at 23 there is the filter, at 24 the actual cigarette itself and at 25 the jointing band.

The said band, since it is not properly sealed over itself, projects in the form of a flag at one outside terminal flap numbered 26.

Each cigarette 1, positioned in the housing defined by two slots 5, is retained in this position by the guides 10 and 11 and is placed in such a way that the part covered with the jointing band 25 projects outside the pair 3 on the side of the disc 6 (see FIGS. 2 and 3).

As the discs 6 and 7 rotate continuously, each cigarette is hit at the side of the filter 23, once in the region of the holes 18 in the tube 17, by jets of air directed along the axis thereof.

This stress brings about the progressive axial sliding of the cigarettes through the openings delimitated by the slots 5 and by the guides 10 and 11, up as far as the halting blade 15, that is to say, over a distance equal virtually to the part covered by the band 25.

Figure 1:
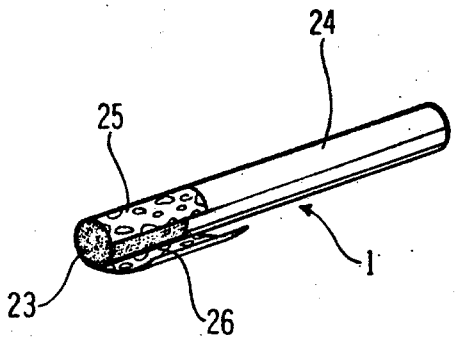
FIG. 1 shows, in a perspective view, a filter cigarette with the fault detected by the device forming the subject of the present invention.

The said axial sliding motion does not take place, however, on the part of those cigarettes 1 that have their jointing bands 25 in the condition depicted in FIG. 1, and this is because the flap 26 constitutes an impediment at the mouthpiece of the said openings.

The cigarettes subsequently arrive at the interruption area **10*a*–11*a* in the blades 10 and 11, where they are retained in their respective housings under the suction action of the block 12**.

As stated, in the said area, jets of air are emitted by the holes 20 of the tube 19 and these are directed downwards, perpendicularly to the axes of the cigarettes.

Only the defective cigarettes 1, excluded from the previous axial sliding motion and having the end covered with the band 25 projecting from the disc 6, are hit by the said jets of air.

The force applied by these is such that it causes the said cigarettes to separate from the suction block 12 and to fall via the interruption area **10*a*–11*a* in the guides 10 and 11** into a bin that is not shown on the drawing.

Downstream of the said interruption area in the guides 10 and 11 and of the elimination of the defective cigarettes, the cigarettes 1 are subjected at the opposite end to the filter to the action of jets of air emitted from the holes 22 in the tube 21, directed along their axis.

This results in a progressive sliding movement on the part of the cigarettes in a direction opposite that caused by the jets of air emitted from the tube 17, until they come to rest against the terminal blade 16.

Once the sliding movement has ended, the cigarettes again occupy inside their respective housings, the positions in which they were formerly, and this is suitable for them to be transferred to the next pair 4.

Figure 4:
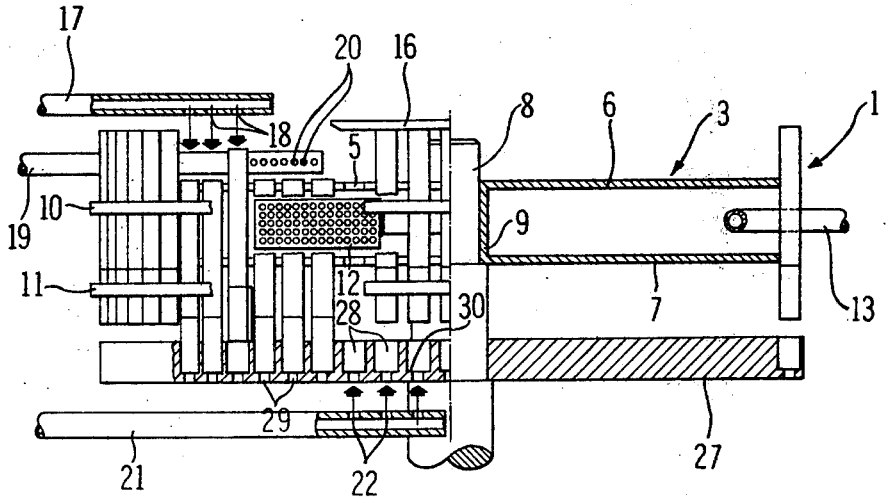
FIG. 4 shows, in the same view as in FIG. 3, a different form of embodiment for the device according to the present invention.

In FIG. 4 a different form of embodiment for the device according to the invention is shown.

This only differs constructionally from the previously described form of embodiment inasmuch as there is a third disc 27 coaxial to the pair 3, this being keyed onto the shaft 8 on the side where the disc 7 is.

The side of the said disc 27 that faces the pair 3 is provided with a ring of cylindrical openings or holes 28 of a diameter approximately slightly greater than the diameter of one cigarette, and these are coaxial to the housings defined by the slots 5.

On the other side of the said disc 27 there are holes 29 which communicate with the bottom 30 of each of the said openings 28, and are coaxial thereto.

In the second form of embodiment, the cigarettes are arranged, with respect to the discs 6 and 7, in an upside down position in comparison with what has been seen previously, that is to say, with the end on which there is the filter, projecting way past the disc 7 in the direction of the disc 27.

Because of the action of the jets of air emitted from the holes 18, cigarettes which have their jointing band sealed perfectly slide axially in their respective housings until they reach the bottom 30 of the holes 28, whilst the flap 26 does not allow the entry into the said holes 28 of cigarettes that are in the state illustrated in FIG. 1.

Exactly as stated previously, the latter are ejected at the interruption area 10*a*–11*a* in the guides 10 and 11 through the action of the jets of air emitted from the holes 20 in the tube 19.

It should be noted that in the second form of embodiment, the function of the halting blade 15 is performed by the bottom 30 of the cylindrical openings 28.

What is claimed is:

1. A device for checking that the bands joining filters to cigarettes have been sealed down, the device comprising transfer means for transferring the cigarettes, one next to the other, in a movement direction crosswise to their longitudinal axes, said transfer means being provided with a succession of housings into which the individual cigarettes fit, the longitudinal dimensions of which are less than the length of one filter cigarette, means for retaining the cigarettes in said housings, the device additionally including first pneumatic means placed laterally with respect to said transfer means, said first pneumatic means generating jets of air, directed axially with respect to the cigarettes, towards and in the direction of openings in axial alignment with said housings into which the cigarettes fit, the width of which being slightly greater than the section of one cigarette; first halting means for halting, inside said housings, the movement of the cigarettes passing through said openings with just that part around which the cigarette-filter jointing band has been placed, under the action of the said first pneumatic means, said first halting means being placed laterally with respect to said transfer means, on the opposite side thereof to where said first pneumatic means are positioned; cigarette interception and ejecting means for intercepting and ejecting the cigarettes from their respective housings in the transfer means, these being placed downstream of said first pneumatic means in the movement direction of said transfer means and laterally thereto on the same side as said first pneumatic means; second pneumatic means placed downstream of said cigarette interception and ejection means, in the movement direction of said transfer means and laterally thereto on the same side as said first halting means, said second pneumatic means generating jets of air directed towards and axially to the cigarettes; second halting means for halting the cigarettes moving inside their respective said housings in said transfer means under the action of said second pneumatic means, said second halting means being placed laterally with respect to said transfer means, on the side thereof where said first pneumatic means and said interception and ejection means are located downstream of the latter with respect to the movement direction of said transfer means.

2. A device according to claim 1, wherein said means for retaining the cigarettes in their respective said housings in said transfer means are constituted by fixed guides which extend parallel to said transfer means and define, with said housings, said openings through which the cigarettes pass under the action of the said first pneumatic means.

3. A device according to claim 2, wherein said fixed guides are interrupted in the vicinity where said intercepting and ejecting means are located.

4. A device according to claim 3 wherein, in the vicinity of the interruption portions in said fixed guides, said means for retaining the cigarettes in their respective said housings in said transfer means are constituted by suction devices which communicate with said housings.

5. A device according to claim 1 wherein said intercepting and ejecting means are constituted by pneumatic members which emit jets of air in a direction virtually perpendicular to said housings and towards the outside of said transfer means.

6. A device according to claim 1, wherein said transfer means are constituted by at least one first disc mounted on a single horizontal shaft and provided with peripheral slots which define said housings in which the individual cigarettes fit, the device including a second disc coaxial with said at least one first disc which constitutes said transfer means, said second disc being rotatably connected thereto and placed, with respect thereto, on the opposite side to that on which said first pneumatic means and said intercepting and ejecting means are located and connected to said second halting means and thus on the same side on which the said second pneumatic means are positioned, said second disc having around its circumference a number of holes in axial alignment with the peripheral slots which form said housings in which the cigarettes fit, these defining said openings through which the cigarettes pass under the action of the said first pneumatic means.

7. A device according to claim 6, wherein said first halting means which halts the movement, under the action of said first pneumatic means in said slots formed by said at least one disc constituting said transfer means, of the cigarettes passing into said holes with which said second disc is provided, are consittuted by a floor at the base of said holes.

8. A device according to claim 7, wherein said floor in said base of said holes in said second disc coaxial to said at least one first disc forming said transfer means constitutes said first halting means, and is provided with through holes and wherein said second pneumatic means are placed on the outside of the said second disc at a point corresponding to the circumference on which the said through holes are arranged.

* * * * *